US007611373B1

(12) United States Patent
LaSalvia

(10) Patent No.: US 7,611,373 B1
(45) Date of Patent: Nov. 3, 2009

(54) COAXIAL CABLE CONNECTOR

(75) Inventor: Jose A. LaSalvia, Sao Jose Dos Campos, SP (BR)

(73) Assignee: Tyco Electronics Brasil LTDA, Sao Paolo (BR)

( * ) Notice: Subject to any disclaimer, the term of this patent is extended or adjusted under 35 U.S.C. 154(b) by 0 days.

(21) Appl. No.: 12/248,235

(22) Filed: Oct. 9, 2008

(51) Int. Cl.
*H01R 4/24* (2006.01)

(52) U.S. Cl. ..... 439/394; 439/821

(58) Field of Classification Search ..... 439/394, 439/469, 472, 578, 583, 584, 820, 821, 822
See application file for complete search history.

(56) References Cited

U.S. PATENT DOCUMENTS 4,053,195 A 10/1977 Laverick et al.
5,928,022 A * 7/1999 Moeller ..... 439/197
6,719,585 B2 * 4/2004 Egbert ..... 439/578
6,736,674 B2 * 5/2004 Korte et al. ..... 439/578
6,884,113 B1 * 4/2005 Montena ..... 439/578
7,214,095 B1 5/2007 Mathews
7,322,851 B2 * 1/2008 Brookmire ..... 439/578
7,384,307 B1 6/2008 Wang
7,473,128 B2 * 1/2009 Montena ..... 439/584

OTHER PUBLICATIONS

J. A. La Salvia, Technological Components for an Anti-Theft System in Overhead Networks, Transmission and Distribution Conference and Exhibition, 2005/2006 IEEE PES, pp. 1307-1314, May 2006.

* cited by examiner

*Primary Examiner*—Thanh-Tam T Le

(57) ABSTRACT

A coaxial connector system is disclosed. The connector system includes a compliance member having an inner conductive portion and an outer portion, the inner conductive portion arranged and disposed for engaging and physically retaining an outer conductor of a coaxial cable. The connector system also includes a conductive actuating clamp having jaws arranged and disposed for engaging and physically retaining an inner conductor of the coaxial cable. The jaws are moveable from an open, pre-engaged configuration to a closed, engaged configuration upon insertion of the inner conductor into the actuating clamp. The connector system can be used to provide a secure connection of a coaxial cable, such as a coaxial energy cable, to a distribution box and thereby deter or prevent energy theft.

17 Claims, 6 Drawing Sheets

COAXIAL CABLE CONNECTOR

FIELD OF THE DISCLOSURE

The present disclosure is directed to electrical connectors and more particularly to a connector for securing a coaxial cable, such as those cables sometimes used in electrical distribution networks.

BACKGROUND OF THE DISCLOSURE

Many of the energy distribution networks in countries around the world are still based on bare aerial cables, mainly in poor areas or where population concentration is not dense enough to justify the expense of an underground distribution system.

While aerial networks have lower installation costs, they can be affected by environmental issues such as atmospheric discharges and storms. They also exhibit higher risk of electrical shock and outages due to trees or other objects coming in contact with the bare conductors.

Aerial cable distribution networks are also very susceptible to energy theft, which has become almost common place in many developing countries. The thieves ordinarily make very rudimentary connections, done without any technical knowledge and using inferior cable and accessories. As a result, besides being illegal, these connections pose a serious safety hazard and can also cause disruptions in the larger power grid.

Various solutions have been implemented to increase safety and security while maintaining an aerial based system that avoids the significant costs associated with underground systems. One such solution is a coaxial energy cable, sometimes referred to as an anti-theft cable. These cables include a central core which serves as a phase conductor, a layer of insulation separating the core from a neutral conductor or shield, and a top layer of insulation encasing the entire cable. As a result, when one tries to steal energy by piercing the cable with a nail or other sharp device to reach the conductor inside, the device is simultaneously in contact with the phase and neutral conductors resulting in a short circuit and making energy theft more difficult.

Notwithstanding these efforts, the conductors in the cable are still exposed at the terminus and as a result are ordinarily connected inside a distribution box that is locked after the connection has been made. However, theft is sometimes aided by the utility field operator who assists the non-paying customers by accessing the distribution box and making the illegal connection.

Currently, there is a lack of satisfactory solutions for providing an interface between the distribution box and the cable that does not compromise the anti-theft advantages achieved by the use of that cable. There is also a lack of satisfactory solutions for easily and automatically making the cable connection without the need for the utility field operator to have access inside the distribution box to make the connection.

These and other drawbacks are found in current coaxial connectors.

What is needed is a connector system for coaxial cables that permits a field operator to prepare a cable end according to installation instructions and plug it into a secured distribution box that is already connected to a meter or other device for measuring and distributing power to the recipients.

SUMMARY OF THE DISCLOSURE

According to an exemplary embodiment, a coaxial cable connector system is disclosed. The connector system includes a compliance member having an inner conductive portion and an outer portion. The inner conductive portion is arranged and disposed for engaging and physically retaining an outer conductor of a coaxial cable. The connector system also includes a conductive actuating clamp having jaws arranged and disposed for engaging and physically retaining an inner conductor of the coaxial cable. The jaws are moveable from an open, pre-engaged configuration to a closed, engaged configuration upon insertion of the inner conductor into the actuating clamp.

According to another exemplary embodiment, a coaxial cable connector system includes a compliance member having a frusto-conical geometry and having a cable inlet at a first end and a cable outlet at a second end. The compliance member includes a plurality of conductive wedge members having an inner surface that define an axial channel through the compliance member, a casing to retain the wedge members within the compliance member, and a spring positioned intermediate the wedge members and the cable outlet to urge the wedge members toward the first end. The connector system also includes an actuating clamp having conductive first and second terminals forming a pair of jaws at a proximal end of the actuating clamp. The jaws have an open configuration and a closed configuration. The actuating clamp further includes a spring between the first and second terminals that is biased to urge the jaws toward the closed configuration in the absence of an applied force and an engagement mechanism moveably positionable with respect to the first and second terminals. The engagement mechanism is configured to provide the applied force to keep the jaws in the open configuration when at a first position with respect to the first and second terminals and to permit the spring to urge the jaws toward the closed configuration when at a second position with respect to the first and second terminals.

An advantage of certain exemplary embodiments described herein is that an electrical connection can be made to a distribution box without requiring internal access to the distribution box, reducing the ability for energy theft to occur.

Another advantage is that installing coaxial energy cable is made easier while also increasing resistance to pull-out forces.

Other features and advantages of the present disclosure will be apparent from the following more detailed description of exemplary embodiments, taken in conjunction with the accompanying drawings which illustrate, by way of example, the principles of the disclosure.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1:
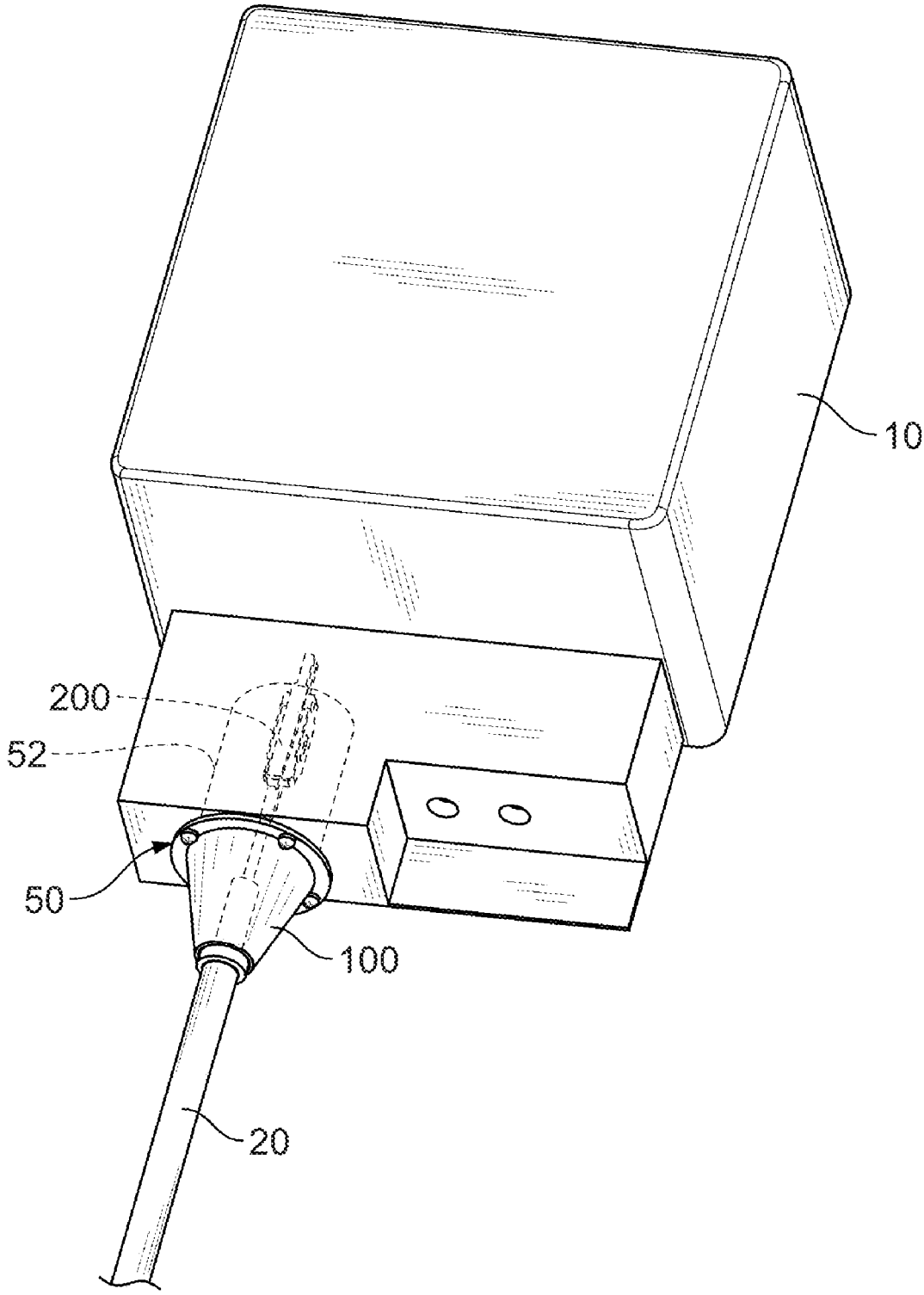
FIG. 1 illustrates a coaxial energy cable connected to a distribution box using a connector system in accordance with an exemplary embodiment of the invention.

FIG. 1 illustrates a distribution box 10 in which a coaxial cable 20 having concentric conductors separated by an insulating layer is electrically connected and physically secured to a distribution network by a connector system 50 in accordance with an exemplary embodiment of the invention. According to a preferred embodiment, the coaxial cable 20 is a coaxial energy cable for the transmission of electricity. As shown, the connector system 50 includes a compliance member 100 positioned external the distribution box and an actuating clamp 200 positioned within a guard 52 that is situated internal the distribution box (shown in broken line and better seen in subsequent figures).

The compliance member 100 helps physically retain the cable 20 and makes electrical contact with an exposed outer conductor of the cable 20, while the actuating clamp 200 also helps retain the cable 20 within the distribution box 10 and makes electrical contact with an exposed inner conductor of the cable 20. As will be discussed in more detail herein, exemplary embodiments of the invention provide a connector system and components thereof that, among other advantages, permit a prepared coaxial cable to be inserted without needing to provide internal access to the distribution box, which can be otherwise enclosed and/or locked and which can thereby deter theft of electricity or signals carried by the cable.

Figure 2:
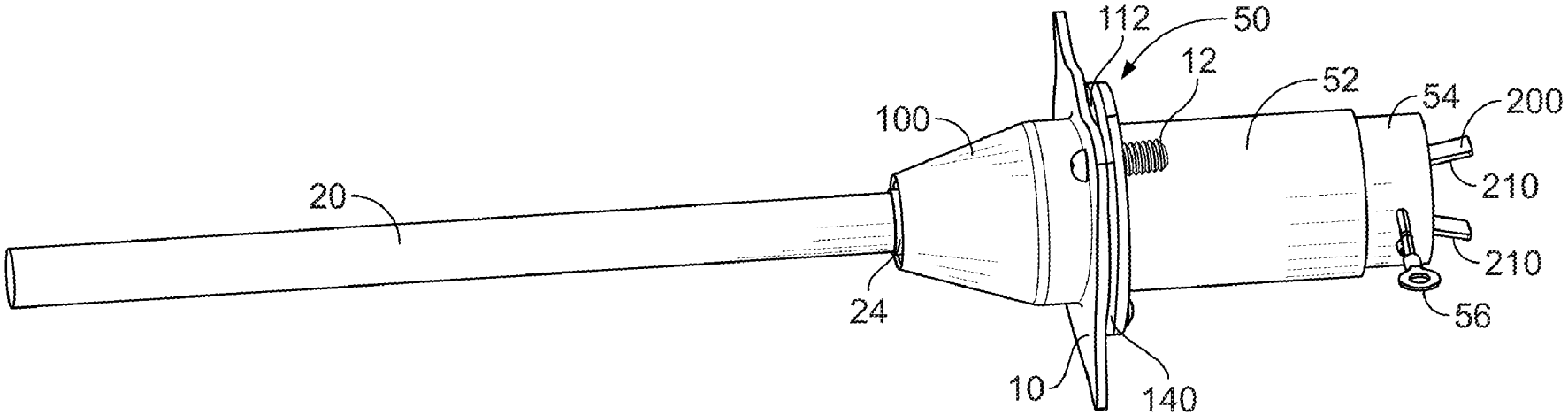
FIG. 2 illustrates a connector system in accordance with an exemplary embodiment of the invention with the distribution box removed.

FIG. 2 shows a perspective view of the connector system 50 with the majority of the distribution box 10 removed for clarity in the illustration. The compliance member 100 includes a protective casing that may be manufactured integral with the distribution box 10 or may be provided as a separate piece that is attached to the distribution box 10 with one or more fasteners 12 passing through a flange 112 formed in the compliance member 100. In FIG. 2, the flange 112 is shown positioned internal the distribution box 10, which may decrease a potential thief's ability to breach the connector system 50 to access the distribution box. Any suitable fasteners may be used including bolts, screws, and rivets, for example.

While all or most of the compliance member 100 is shown in FIGS. 1 and 2 being positioned external the distribution box 10, it will be appreciated that in some embodiments, the entire connector system 50 could be positioned internal the distribution box 10, provided a suitable aperture is provided in the box 10 to allow the cable 20 entry into the connector system 50 for physical retention and electrical contact.

Figure 3:
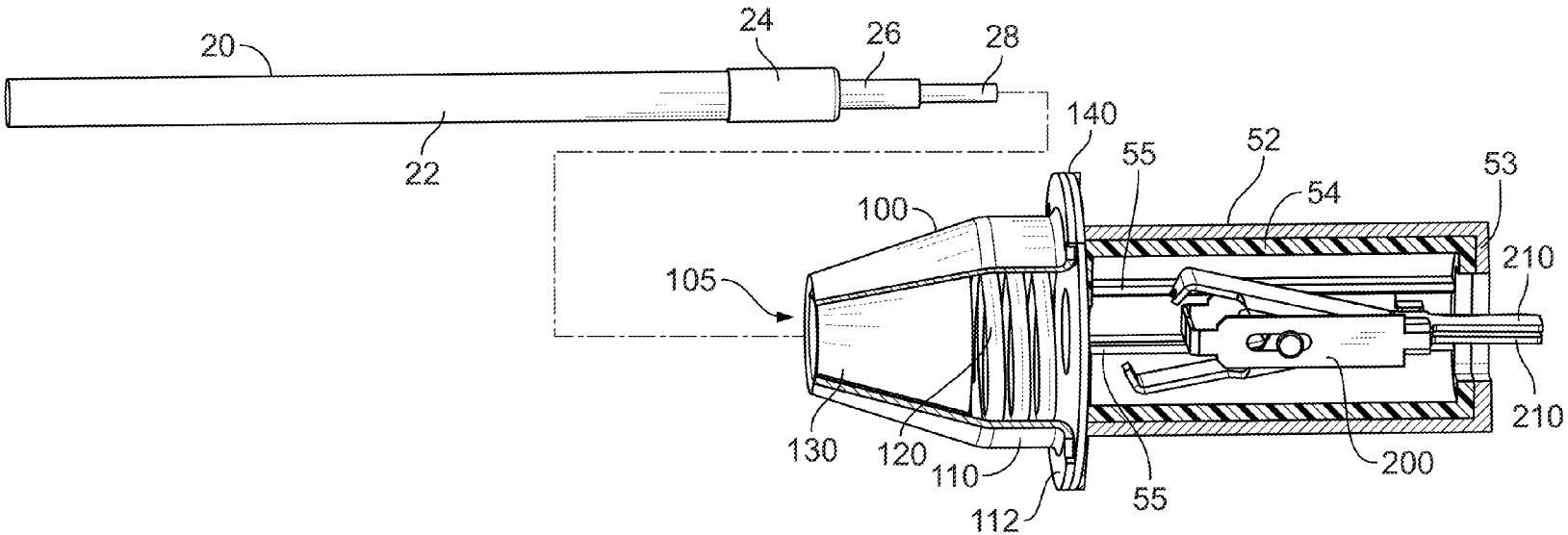
FIGS. 3 and 4 illustrate a partial cutaway view of a connector system in accordance with an exemplary embodiment before and after insertion of a coaxial cable, respectively.

Inside the distribution box 10, the connector system 50 includes the actuating clamp 200 (better seen in FIG. 3). The actuating clamp 200 is made of a metallic or otherwise conductive material. In some embodiments, the actuating clamp 200 may be electrically connected to the distribution network by contacts or terminals soldered or otherwise attached directly to upper and lower terminals 210 of the actuating clamp 200. In other embodiments, a separate connection 56 such as short lead lines attached to a ring terminal may also be provided to carry electrical current from the actuating clamp 200 to one or more connections within the distribution box.

As also illustrated in FIG. 2, the actuating clamp 200 may be disposed within the distribution box 10 inside an insulative housing 54, which may be formed from one or more pieces of a non-conductive plastic or rubber. As also illustrated, a guard 52 may be provided over the insulative housing 54. The use of an insulative housing 54 and/or a guard 52 further helps keep the actuating clamp 200 properly positioned with respect to the compliance member 100 to receive the inner conductor when a cable is being installed using the connector system 50. The housing 54 may be maintained within the guard 52 by an interference fit between the two as shown in FIG. 2. Alternatively, or in combination, the housing 54 may be retained within the guard 52 by a lip 53 extending from the guard 52. A locking mechanism or any other method of attachment could also be used.

In one embodiment, a metallic guard 52 is provided that is connected to and electrically common with the compliance member 100, for example, by a fastener 12 that extends through a flange in each of the compliance member 100 and the guard 52. In the event access to the distribution box 10 is compromised, an individual piercing the guard 52 to reach the actuating clamp 200 (to which the internal conductor of the cable 20 is electrically connected) with a nail or other sharp, conductive device would cause a short circuit in much the same way as piercing the cable 20 external the distribution box 10.

A closing plate 140 and/or one or more interfacial seals (not shown) may be provided between the guard 52 and the distribution box 10 and/or between the compliance member 100 and the distribution box 10. The distribution box 10, compliance member 100 and any guard 52 are preferably electrically common, which can be achieved by the use of conductive fasteners 12 to secure the components to one another.

Figure 4:
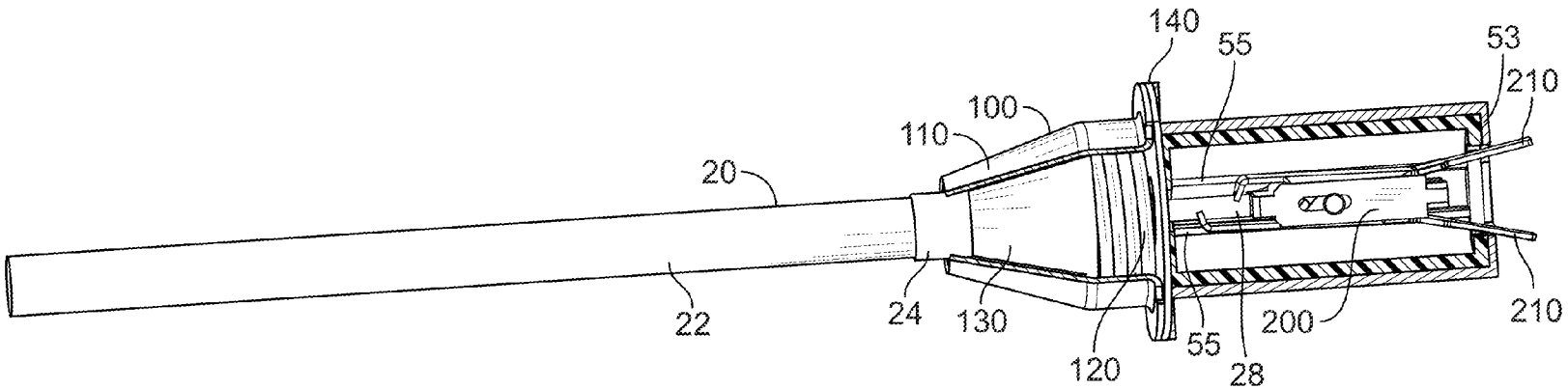

FIGS. 3 and 4 show a partial cutaway view of an exemplary embodiment of a connector system 50 prior and subsequent to insertion of a coaxial energy cable 20 in which the distribution box 10 has been removed entirely for illustration purposes. It will be appreciated that one or more seals as well as the wall of the distribution box 10 may be present intermediate the compliance member 100 and the guard 52, as previously shown in FIG. 2.

The compliance member 100 has a frustal geometry and in one embodiment includes a frusto-conical casing 110, along with a spring 120 and a plurality of conductive wedge members 130 inside the casing 110. The conductive wedge members 130 together have a frusto-conical geometry and exert a clamping force on the outer surface of a cable 20 inserted through the compliance member 100 by the spring 120 which pushes the wedge members 130 toward a narrow first end of the casing 110. In some embodiments, a closing plate 140 is positioned over the outlet at the wider second end of the casing 110 to provide a wall opposite a facing surface 133 (FIG. 5) of the wedge members 130 against which the spring 120 is situated. As illustrated, the compliance member 100 is arranged to receive the coaxial energy cable 20 through a channel 105 that passes from an inlet at the narrow end of the frustal compliance member 100 to the outlet at the wider end of the compliance member 100. The diameter of the channel 105 is defined by the inner surfaces 134 (FIG. 5) of the wedge members 130.

As best seen in FIG. 3, the coaxial cable 20 is prepared for insertion into the connector system 50 to expose both the inner conductor 28 and the outer conductor 24. The inner conductor 28 may be solid or a plurality of twisted strands, while the outer conductor 24 is ordinarily stranded or a foil. In either case, the outer conductor 24 can be doubled back over an outer insulating layer 22. This has the effect of exposing a portion of an inner insulating layer 26 that provides an insulated distance between the exposed inner and outer conductors 28, 24. It further has the effect of increasing the thickness of the cable 20 at the location at which the outer conductor 28 is contacted by the compliance member 100, which may be advantageous for physical retention. In the case of a coaxial energy cable, the inner conductor 28 is the phase conductor and the outer conductor 24 is the neutral conductor.

A cable prepared in this manner results in the outer conductor 24 being positioned for contacting the conductive wedge members 130, while the smaller diameter phase conductor 28 passes through the compliance member 100 into the open mouth of the actuating clamp 200. The force of insertion actuates the jaws of the actuating clamp 200, causing them to close and thereby trapping the inner conductor 28 (FIG. 4) between them. Both conductors 24, 28 are thus physically retained by the connector system 50 and are both in electrical contact with respective (electrically isolated) conductive paths to complete a circuit between the cable 20 and the distribution box 10.

Figure 5:
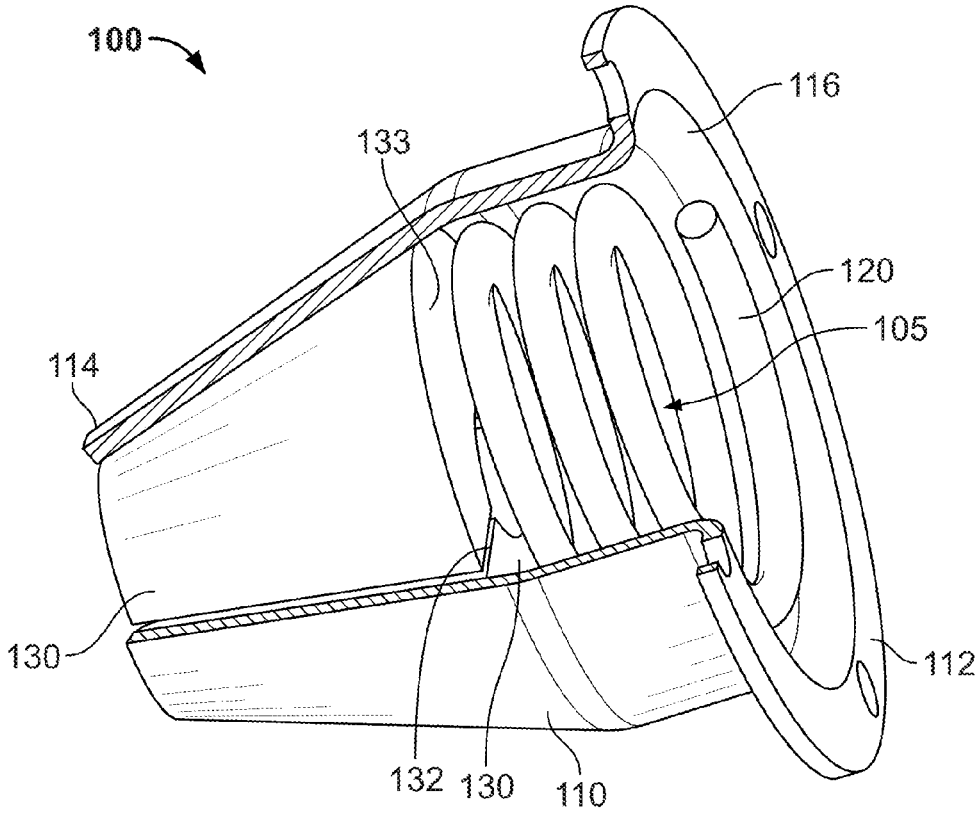
FIGS. 5 and 6 illustrate alternative perspective views of a compliance member in accordance with an exemplary embodiment of the invention.
Figure 6:
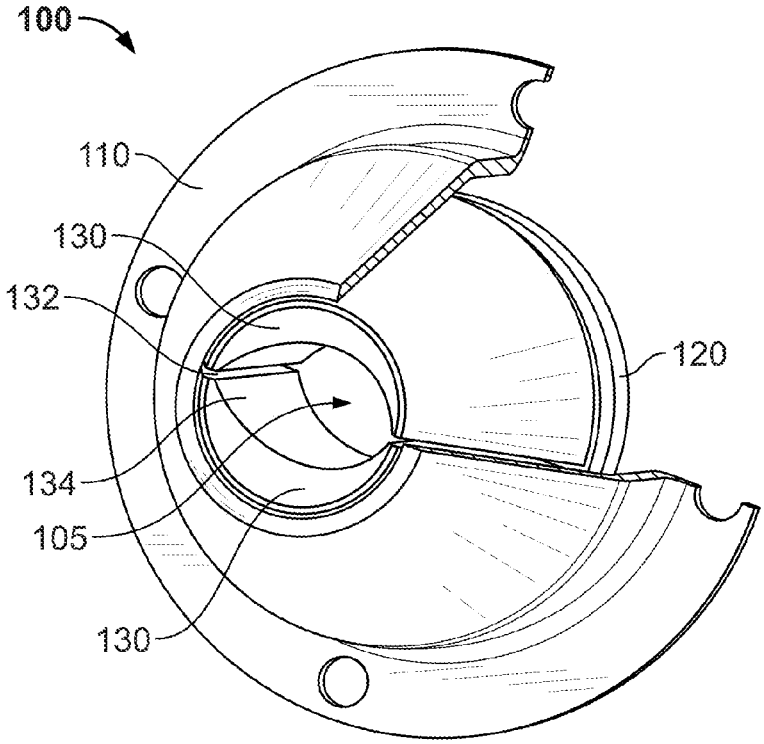

FIGS. 5 and 6 show an enlarged version of the frustal compliance member 100 which expands from a narrower, first end 114 at the inlet to a wider, second end 116 at the outlet. The compliance member includes the casing 110 (again shown as partially sectioned for clarity in illustration). The casing 110 may include a flange 112 having a plurality of apertures through which fasteners may be provided to secure the compliance member 100 to the distribution box 10 (FIGS. 1 and 2), including any intermediate seals or closing plate 140 (FIG. 3).

FIGS. 5 and 6 illustrate the cooperative relationship between the conductive wedge members 130. The channel 105 defined by the conductive wedge members 130 is narrower than the diameter of the coaxial cable 20. As a result, when the cable 20 is inserted through the inlet of the compliance member 100 and into the channel 105, the exposed outer conductor 24 contacts the inner surface 134 of the wedge members 130. This in turn forces the wedge members 130 to move in the same axial direction as the cable 20 and away from their initial position in the casing 110, which in one embodiment is adjacent the compliance member inlet. The wedge members 130 are ordinarily independent pieces that meet at an interface 132.

The wedge members 130 are free to move away from one another as they travel axially from the first end of the casing 110 toward the second end when pushed by the entering cable 20 which, having a larger diameter than the channel 105, cannot pass through it. A gap forms between the interface 132 of the wedge members 130 that results in the diameter of the channel 105 increasing as the distance from the first end increases. The compliance mechanism 100 is configured such that the size of the wedge members 130 and the distance traveled allows channel 105 to sufficiently expand to allow the cable 20 to pass through it. Although two conductive wedge members 130 are illustrated, it will be appreciated that more than two may be used.

The inner surfaces 134 of the wedge members 130 may be parallel with the cable axis or they may be angled to exert a radially inward force on the cable 20, which can prevent it from being removed from the compliance member 100 if a pulling force is applied to the cable 20. While the inner wedge surfaces 134 may be angled, clamping force for retaining the cable 20 in the compliance member 100 is also provided by the spring 120. As the wedge members 130 travel axially away from the inlet during cable insertion and the diameter of the channel 105 increases, the spring 120 is compressed between the facing surface 133 of the wedge members 130 and the closing plate 140 (or alternatively, the wall of the distribution box 10 if a closing plate is not present). When the insertion force is removed, the spring 120 expands back toward its uncompressed position, forcing the wedge members 130 back toward the inlet at the narrow end of the compliance member 100. This in turn provides a clamping force that prevents the cable 20 from being removed from the connector when pulling in a direction opposite of that in which the cable was inserted.

While the outer (neutral) conductor 24 is clamped by the compliance member 100, the smaller diameter of the inner (phase) conductor 28 allows it to pass entirely through the compliance member 100. The use of a closing plate 140 with the compliance member 100 can reduce the size of the exit from the compliance member 100, for example, to be only slightly larger than the diameter of the inner conductor 28. This may further limit internal access to the distribution box during the cable installation process. After passing through the compliance member 100, the inner conductor 28 engages the actuating clamp 200.

Figure 7:
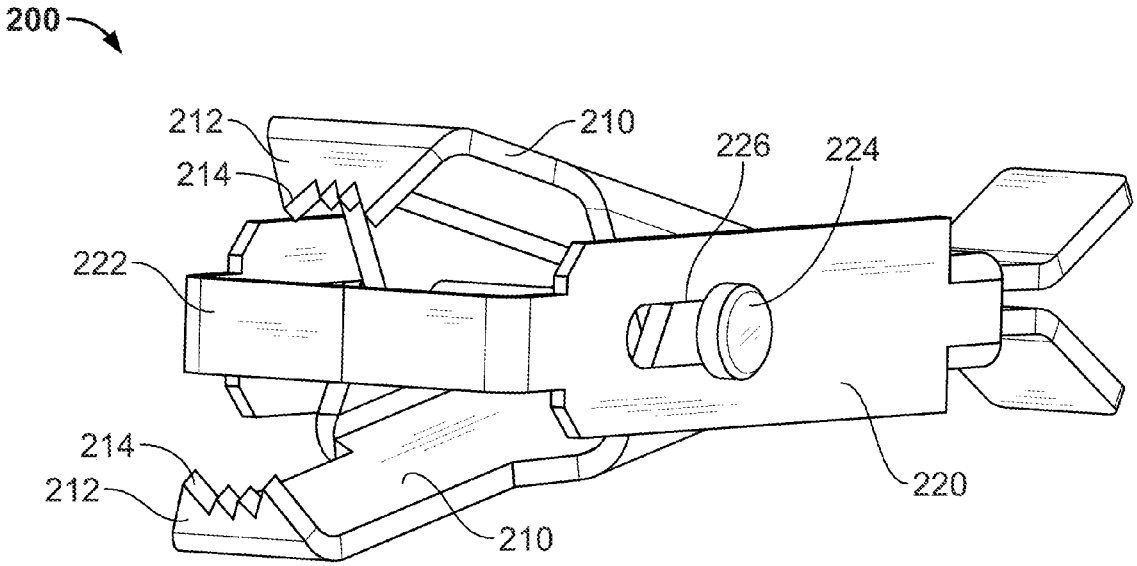
FIG. 7 illustrates a front perspective view of an actuating clamp in accordance with an exemplary embodiment of the invention in the pre-engaged position.

Turning to FIG. 7, a front perspective view of the actuating clamp 200 is shown in an open, pre-engaged configuration. The actuating clamp 200 includes first and second terminals 210 having two opposing jaws 212 at a proximal end of the terminals 210. The actuating clamp further includes an engagement mechanism 220 that causes the actuating clamp 200 to go from the open configuration to a closed, engaged configuration when the inner conductor 28 is inserted. As illustrated, the jaws 212 may include teeth 214 which can increase mechanical grip, pierce any oxide film surrounding the inner conductor 28, and provide better low contact resistance assurance when the jaws 212 are closed around the inner conductor 28 upon the cable 20 being fully inserted into the connector system 50.

The engagement mechanism 220 includes a contact surface 222 extending laterally across the mouth (i.e. proximal end) of the actuating clamp 200. The contact surface 222 is positioned to be contacted by the phase conductor 28 upon the coaxial cable 20 being inserted into the connector 50. The engagement mechanism 220 further includes a longitudinal slot 226 along at least one side wall of the mechanism 220. A pin 224 is positioned within the slot 226 so that the pin and slot together define a linear path of travel for the engagement mechanism 220 that is essentially parallel with the axial movement of the cable 20 during insertion. The engagement mechanism 220 also provides a surface that can be engaged by rails 55 (FIGS. 3 and 4) formed in the insulative housing 54 to secure and prevent undesired movement of the clamp 200 within the housing 54.

Figure 8:
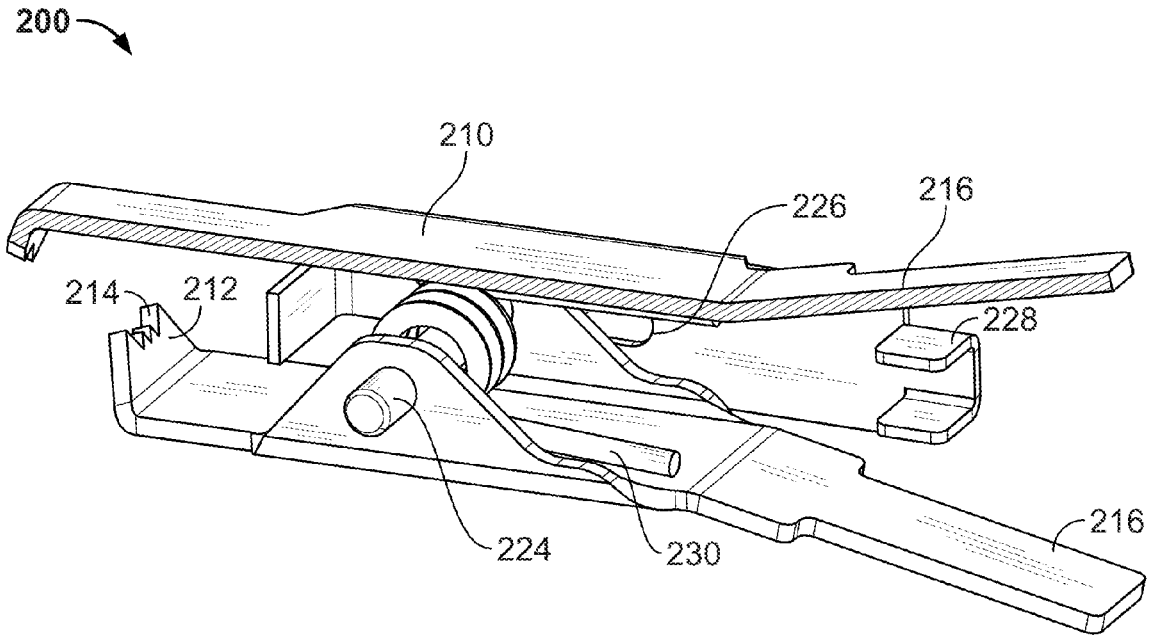
FIG. 8 illustrates a partial cross-sectional view of the actuating clamp in the engaged position.
Figure 9A:
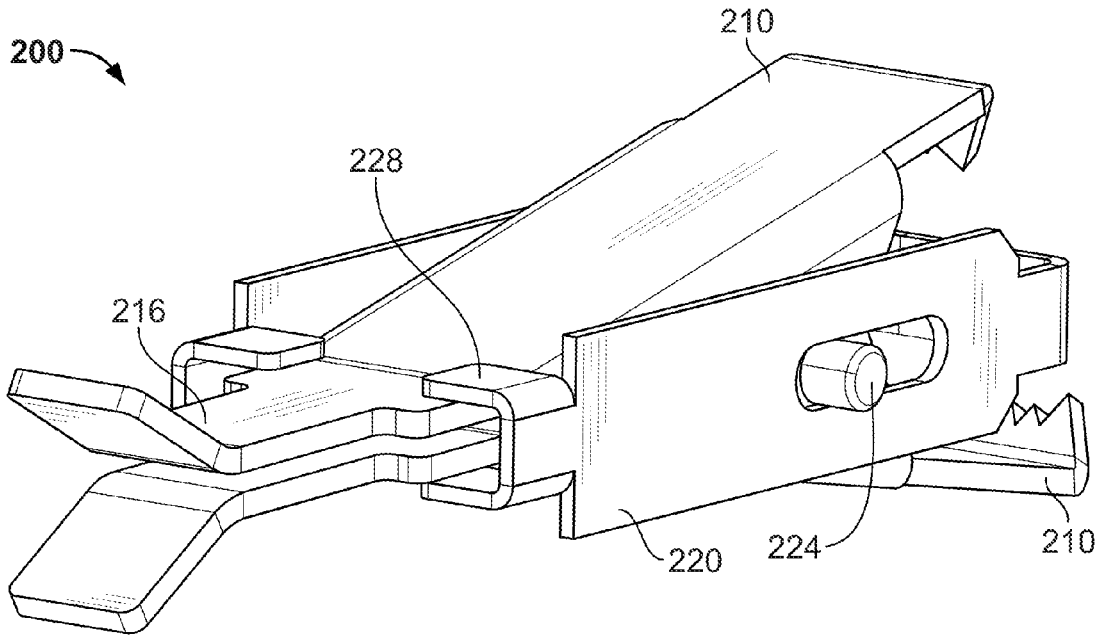
FIGS. 9*a* and 9*b* illustrate rear perspective views of the actuating clamp of FIG. 7 in the pre-engaged and engaged position, respectively.
Figure 9B:
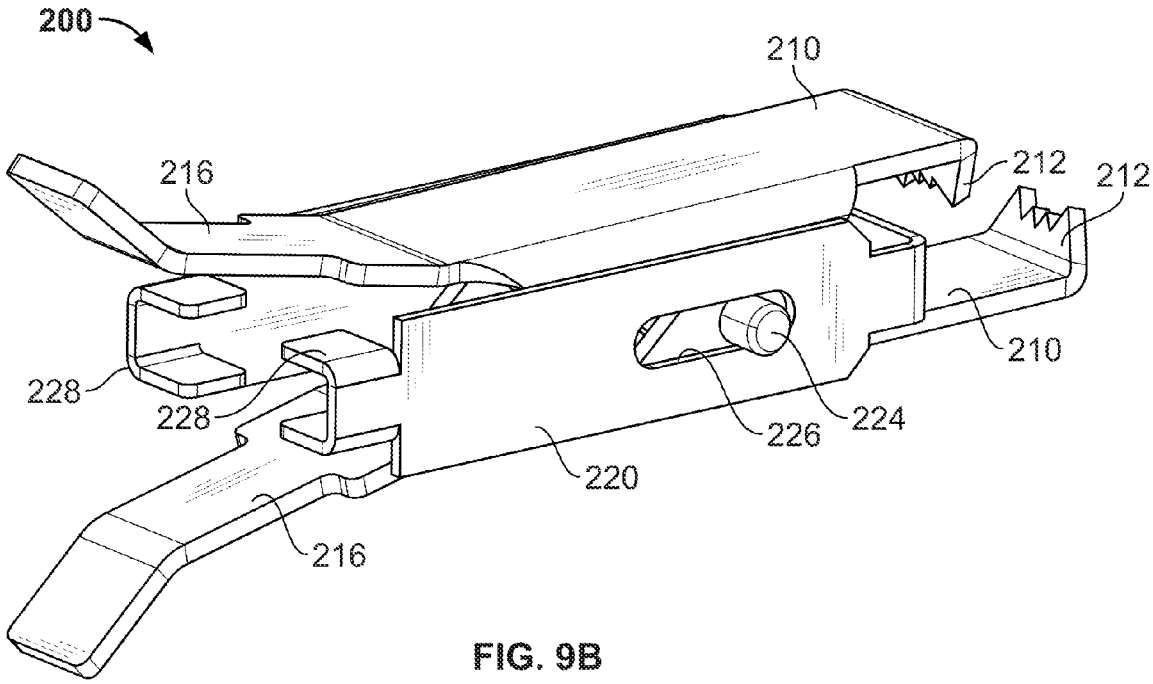

The jaws 212 operate in a clothes-pin like manner, being biased toward the closed configuration by a spring 230 (FIG. 8) positioned within the actuating clamp 200. Turning to FIGS. 9*a* and 9*b*, the jaws 212 are held open by a retainer 228 formed in the engagement mechanism 220 that partially surrounds a distal portion 216 of the first and second terminals 210. Preferably, a second retainer 228 is formed on the opposite side of the engagement mechanism 220. Although the bias of the spring 230 exerts a force trying to close the jaws 212, the jaws are prevented from closing by the retainers 228 holding the distal portion 216 of the terminals 210 in close proximity to one another.

When the phase conductor 28 is inserted into the connector system 50, it exerts a force on the contact surface 222 and pushes the engagement mechanism 220 rearward along the linear path of travel defined by the slot 226 and pin 224. As the engagement mechanism travels, the retainers 228 move toward the distal end of the actuating clamp 200. At a point along the distal portion 216 intermediate where the retainers 228 are initially positioned to hold the clamp 200 in the open configuration and the distal end of the clamp 200, the width of the terminals 210 becomes too narrow to be held by the retainers 228. The retainers 228 can no longer engage the terminals 210 and, as a result, the spring force is no longer countered away from the biased position and the jaws 212 snap closed.

While primarily described herein with respect to a coaxial energy cable, the connector system discussed herein can be used with other types of coaxial cable. It will further be appreciated that the components of the connector system, such as the compliance member and/or the actuating clamp, could be used independently in systems other than those having a coaxial cable.

Thus, while the foregoing specification illustrates and describes exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A coaxial cable connector system comprising:

a compliance member having an inner conductive portion and an outer portion, the inner conductive portion arranged and disposed for engaging and physically retaining an outer conductor of a coaxial cable; and a conductive actuating clamp having jaws arranged and disposed for engaging and physically retaining an inner conductor of the coaxial cable, wherein the jaws are moveable from an open, pre-engaged configuration to a closed, engaged configuration upon insertion of the inner conductor into the actuating clamp;

wherein the actuating clamp comprises a first terminal and a second terminal connected to the first terminal, the jaws formed at a proximal end of the first and second terminals, a spring biased to urge the jaws toward the closed configuration in the absence of an applied force, and an engagement mechanism to provide the applied force to keep the jaws in the open configuration prior to insertion of the inner conductor, and wherein the engagement mechanism comprises a contact surface extending laterally across the jaws of the actuating clamp, a longitudinal slot formed in a side wall of the engagement mechanism and a pin extending laterally across the actuating clamp through the slot, the slot and pin defining a linear path of travel for the engagement mechanism with respect to the terminals.

2. The coaxial cable connector system of claim 1, wherein the compliance member has a frustal geometry having a first end and a second end, the compliance member having a cable inlet at the first end and a cable outlet at the second end.

3. The coaxial cable connector system of claim 2, wherein the inner conductive portion comprises a plurality of wedge members having an inner surface that define a diameter of an axial channel through the compliance member and wherein the outer portion comprises a casing to retain the wedge members within the compliance member.

4. The coaxial cable connector system of claim 3, wherein the compliance member further comprises a closing plate at the second end of the compliance member and a spring positioned within the compliance member intermediate the wedge members and the closing plate, the spring configured to urge the wedge members toward the first end of the compliance member.

5. The coaxial cable connector system of claim 3, wherein the casing comprises a flange for attaching the compliance member to a distribution box.

6. The coaxial cable connector system of claim 3, wherein the wedge member inner surfaces are angled to exert a radially inward retention force on the cable.

7. The coaxial cable connector system of claim 1, wherein the terminals have a first width and a second width narrower than the first width and wherein the engagement mechanism comprises a retainer movably positionable from a position along the terminals having the first width to a position along the terminal having the second width to permit the jaws of the actuating clamp to the closed position.

8. The coaxial cable connector system of claim 1, wherein the jaws comprise teeth arranged and disposed for engaging the inner conductor of the coaxial cable.

9. The coaxial cable connector system of claim 1, wherein the actuating clamp is at least partially positioned within an insulative housing.

10. The coaxial cable connector system of claim 9, wherein the insulative housing is at least partially surrounded by a conductive guard attached to and electrically common with the compliance member.

11. The coaxial cable connector system of claim 1, wherein the coaxial cable is a coaxial energy cable.

12. A coaxial cable connector system comprising:

a compliance member having a frusto-conical geometry having a cable inlet at a first end and a cable outlet at a second end, the compliance member comprising a plurality of conductive wedge members having an inner surface that define a diameter of an axial channel through the compliance member, a casing to retain the wedge members within the compliance member, and a spring positioned intermediate the wedge members and the cable outlet to urge the wedge members toward the first end; and an actuating clamp comprising conductive first and second terminals forming a pair of jaws at a proximal end of the actuating clamp, the jaws having an open configuration and a closed configuration, a spring between the first and second terminals and biased to urge the jaws toward the closed configuration in the absence of an applied force, and an engagement mechanism moveably positionable with respect to the first and second terminals, the engagement mechanism configured to provide the applied force to keep the jaws in the open configuration when at a first position with respect to the first and second terminals and to permit the spring to urge the jaws toward the closed configuration when at a second position with respect to the first and second terminals.

13. The coaxial cable connector system of claim 12, wherein the engagement mechanism comprises a contact surface extending laterally across the jaws of the actuating clamp, a longitudinal slot formed in a side wall of the engagement mechanism and a pin extending laterally across the actuating clamp through the slot, the slot and pin defining a linear path of travel for the engagement mechanism from the first position to the second position.

14. The coaxial cable connector system of claim 13, wherein the engagement mechanism comprises a retainer partially surrounding the terminals when in the first position.

15. The coaxial cable connector system of claim 12, wherein the actuating clamp is partially contained within an insulative housing and wherein the insulative housing is partially contained within a rigid conductive housing connected to the compliance member casing, wherein the conductive housing and the casing are electrically common.

16. The coaxial cable connector system of claim 12, wherein the connector system is attached to an electrical distribution box.

17. An electrical connector comprising:

a conductive first terminal and a conductive second terminal, the terminals having a proximal end and a distal end, the terminals forming a pair of jaws at the proximal end of the actuating clamp, the jaws having an open configuration and a closed configuration;

a spring positioned between the first and second terminals and biased to urge the jaws toward the closed configuration in the absence of an applied force; and an engagement mechanism moveably positionable with respect to the first and second terminals, the engagement mechanism comprising a contact surface extending laterally across the jaws, a longitudinal slot formed in a side wall of the engagement mechanism and a pin extending laterally across the actuating clamp through the slot, the slot and pin defining a linear path of travel for the engagement mechanism from a first position with respect to the terminals to a second position with respect to the terminals, wherein the engagement mechanism is configured to provide the applied force to keep the jaws in the open configuration when at the first position and to permit the spring to urge the jaws toward the closed configuration when at the second position.

* * * * *